US006163733A

United States Patent [19]

Rubel

[11] Patent Number: 6,163,733

[45] Date of Patent: Dec. 19, 2000

[54] MONITOR AND MALFUNCTION PREDICTOR FOR TEXTILE MACHINES

[76] Inventor: Laurence P. Rubel, 600 Star St., Oakhurst, N.J. 07755

[21] Appl. No.: 09/287,033

[22] Filed: Apr. 6, 1999

[51] Int. Cl.[7] ..... G06F 15/46; D01H 13/14

[52] U.S. Cl. ..... 700/130; 700/131

[58] Field of Search ..... 700/130, 136, 700/138–144; 112/273, 278; 56/264

[56] References Cited

U.S. PATENT DOCUMENTS

| | | | |
|---|---|---|---|
| 2,881,833 | 4/1959 | Hoffee | 164/17.5 |
| 3,058,343 | 10/1962 | Hutchens et al. | 73/160 |
| 3,177,749 | 4/1965 | Best et al. | 83/208 |
| 4,031,924 | 6/1977 | Domig et al. | 139/336 |
| 4,110,654 | 8/1978 | Paul | 310/323 |
| 4,286,487 | 9/1981 | Rubel | 83/58 |
| 4,381,803 | 5/1983 | Weidmann et al. | 139/370.2 |
| 4,429,651 | 2/1984 | Tajima | 112/273 |
| 4,566,319 | 1/1986 | Yamazaki et al. | 73/160 |
| 4,619,213 | 10/1986 | Iimura et al. | 112/273 |
| 4,628,847 | 12/1986 | Rydborn | 112/273 |
| 4,763,588 | 8/1988 | Rydborn | 112/273 |
| 4,817,381 | 4/1989 | Meissner | 57/265 |
| 5,146,739 | 9/1992 | Lorenz | 57/264 |
| 5,184,305 | 2/1993 | Gronenberg | 700/130 |
| 5,237,944 | 8/1993 | Willenbacher et al. | 112/273 |
| 5,388,618 | 2/1995 | Decock | 139/1 R |
| 5,838,570 | 11/1998 | Barea | 700/130 |

*Primary Examiner*—William Grant
*Assistant Examiner*—Kidest Bahta
*Attorney, Agent, or Firm*—Woodbridge & Associates, P.C.; Richard C. Woodbridge

[57] ABSTRACT

A monitor and malfunction detector for the thread feed of a textile machine. The monitor combines electronic information and mathematical analysis of the movement of the thread, including speed, tension and fiber and consistency, thereby permitting the determination of: 1) presence of knots and inconsistencies in the thread 2) the operating status of the textile equipment and thread feed; 3) the prediction of problems based upon the change of operating characteristics including speed, tension, draw and duty cycle patterns; 4) the control of the textile machine being monitored; 5) the diagnosis of mechanical faults; 6) production accounting; and 7) needle burr detection. The monitor also employs a unique signal comparison incorporating differential circuitry, pattern recognition, and averaging functions to achieve these goals efficiently and reliably.

31 Claims, 3 Drawing Sheets

MONITOR AND MALFUNCTION PREDICTOR FOR TEXTILE MACHINES

CROSS REFERENCE TO RELATED APPLICATIONS

This application is related to my prior application Ser. No. 08/736,076 filed Oct. 24, 1996, now abandoned, and entitled "Monitor and Malfunction Indicator and Predictor for Textile Machines", the entire contents and substance of which are incorporated herein by reference.

BACKGROUND OF THE INVENTION

1. Field of the Invention

The invention relates to a textile machine monitor which applies several methods of electronic processing to signals received from a thread feed sensor.

2. Description of Related Art a. Thread Monitors

The prior art includes a variety of mechanical and electrical devices for monitoring and controlling textile equipment. The present invention adds a number of capabilities that are not addressed in the prior art.

A common thread/yarn monitor employs a mercury switch device which maintains an open circuit condition while the thread/yarn is under tension at the switch location. In the event the thread breaks, a closed circuit results indicating the breakage.

Electronic thread motion sensor devices utilize in the prior art, such as described in U.S. Pat. No. 4,429,651, (Tajima), includes a motion/no motion sensor wherein a fault/break is indicated when "no motion" is detected when "motion" is required. The current invention can act prior to thread break, which can prevent: 1) damage to the finished product resulting from snags or mechanical failures which occur prior to a thread break; 2) damage to machines which can occur prior to a thread break, for example, when large amounts of thread wrap on the take-up cam shaft; and 3) waste of time and thread when operators of automatic machines monitor and remove thread spools before exhaustion in order to prevent a break at the end of the spool.

Much of the prior art is limited to tension sensing/analysis, but electronic tension sensing/analysis can address only limited and specific issues. Such prior art include: U.S. Pat. Nos. 5,237,944 to Willenbacher, et al.; 4,628,847 to Rydborn; and, 4,763,588 to Rydbom. U.S. Pat. No. 5,237,944 to Willenbacher, et al., in fact states that "[m] measurement experiments have shown that such parameters as the speed of sewing, stitch length, and the thread properties cause only insignificant changes in the maximum of the voltage peaks, whereas the setting of the tensioning device substantially affects it." U.S. Pat. No. 5,237,944 is directed to the analysis of tension changes that are generated by take up type elements of a sewing machine. That invention, however, also requires input feedback from a machine shaft position sensor and detects only a specific input signal pattern for a designated machine type. Changes in machine type or take-up structure would require fundamental design changes to the invention. The present invention provides for an analysis on all textile machine types an requires no machine retrofit.

U.S. Pat. No. 4,110,654, issued to Andreas Paul, describes a sensor wherein a member vibrates when excited by a traveling yarn. That invention, however, does not include a signal processing means. In addition, the vibration frequency of the vibrating member is affected by the attachment of piezo type devices to the vibrating member. Failure to match a precise vibrating frequency to requirements can produce a high signal to noise ratio. While vibration isolation and vibration frequency differences of vibrating member and a base are determined in U.S. Pat. No. 4,110,654, there is no provision for these factors for upstream or downstream thread guides. Also, that invention suggests an enclosure to contain the effect of airborne noise, but, a mechanical enclosure may, result in compaction of dust. The vibration means of the present invention is relatively insensitive to air noise, due to its low mass, small cross sectional area made possible by its simple design and to the independent, non-machine mounting of sensor assembly.

U.S. Pat. No. 4,381,803 issued to Weidmann, et al., is primarily directed to determining tension in weaving machines at various stages of weft insertion. That invention includes a motion responsive member consisting of a piezoelectrical system set into vibration by filament movement. The piezo element itself, however, can impact the vibration frequency, and the sensor does not control or define vibration frequency. In addition, the electronic circuit is not frequency filtered/tuned. The sensor signal amplitude is compared to fixed/set values in order to generate rectangular pulses, which are then matched to the machine via a rotating disk affixed to the machine. Also, no provision is made to control dust compaction.

U.S. Pat. No. 4,619,213 (Iimura, et al.), measures thread draw duing stitch formation by wrapping thread on a pulley and sensing the rotation of the pulley. Angular momentum of the pulley prevents detection of rapid start and stop thread movement generated by textile machine take up action and stitch formation. The present invention, on the other hand, determines draw as a function of thread sensor signal and time.

U.S. Pat. No. 4,566,319 (Yamazaki, et al), entitled "PROCESS AND APPARATUS FOR MEASURING THERMAL SHRINKAGE PROPERTIES OF YARN" and U.S. Pat. No. 5,146,739 (Hellmut Lorenz) entitled "YARN FALSE TWIST TEXTURING PROCESS AND APPARATUS", both describe devices for monitoring various criteria, including, the tension of thread or yarn to detect abnormal characteristics such as "false twisting" and shrinkage. The Yamazaki device uses pulleys to determine speed. As in U.S. Pat. No. 4,619,213, above, angular momentum imposes limits to speed change sensitivity. In addition, neither device detects the presence of a knot or the like.

U.S. Pat. No. 3,058,343 (G. H. Hutchens, et al.) entitled "APPARATUS FOR MONITORING YARN SURFACE DEFECTS", and U.S. Pat. No. 2,881,833 (J. M. Hoffee) entitled "SEWING MACHINE ATTACHMENT FOR CUTTING SEAM BINDING" are of general interest only in that they disclose devices for monitoring and/or cutting threads or fabrics employed in textile production.

Prior literature also describes commercially available systems for monitoring the delivery of threaded yarn. Several such systems are produced and sold by Eltex of Sweden, Inc., Greer, S.C. In such systems, a hole, or eyelet, which may include a piezoelectric element, detects the presence or absence of thread or yarn.

There are combined commercial thread cutters and detectors available on the market such as those available from Fli Control and sold by Wilson Controls & Meters Co., Inc., Harrisburg, N.C. 28075.

Prior art sensors do not have specific means to sense knots and material inconsistencies, nor are they directed to speed sensitivity. Likewise, prior art electronic processing generally does not include means to determine or predict operating status based on average or trend changes for a multiplicity of duty cycles (stitches). The prior electronic processing art generally does not identify a time and signal magnitude pattern generated by thread take up for a singular stitch/duty cycle based on sensed thread/fabric speed. Moreover, the prior art does not generate a numerical or voltage value which is a combined function of duty cycle time plus speed parameters for a (singular) duty cycle/stitch. In addition, the prior art generally does not address automatic machine diagnosis based on thread sensor input. U.S. Pat. No. 5,388,618, (Decock) for example, uses operator supplied input for machine diagnosis. The prior art does not address stitch count/production accounting using thread/fabric sensor output. The prior art does not produce an accurate measure of fabric processed wherein measure is derived from output of a thread sensor. Lastly, the prior art does not provide means to detect burrs on needles.

In detail, among the advantages provided by the sensor in the present invention over prior art sensors is that: 1) speed as well as tension is sensed, such that speed sensitivity is combined with electronic analysis revealing aspects of machine operation that are unavailable from the cited systems; and 2) unlike the patent disclosures cited herein, the present invention provides for controlled sensing of knots and fiber inconsistencies. Acceptable knot/inconsistency dimensions are set by sensor design.

The current electronic processor indicates and predicts malfunctions via several unique signal processing methods. The methods include: 1) use of signal magnitude comparison plus rate of change (derivative function) which allows simple enhanced identification of inconsistencies such as knots and filament inconsistency, and identification of burred needles from appropriate thread sensor input; 2) use of thread sensor output to identify thread time and speed patterns for a singular stitch/duty cycle. Control values (voltage or numerical) that are a function of combined amplitude and time parameters permit simple identification of operational change or malfunction for general machine types. User adjustment/input to the function of speed or time allows easy application of the present embodiment to any textile process; 3) determination of long term average sensor signal for a multiplicity of duty cycles/stitches which, in turn, provide for analysis of small changes and trends. This combination of speed and time allows for the determination of operation status, using thread drawn in during a given period of time. In addition, for adjustment the averaging time period is shortened, it is gradually increased after start up, and the upper and lower limits used to compare with the average gradually converge after start up.

The use of sensor and signal processing in the current embodiment allows this monitor to be moved from one type of machine to anotwithout requiring machine retrofit. In addition, elements of this invention can be used separately or together on many different types of textile machines. The present invention comprises a low or zero tension device. The sensor, by not requiring or exerting tension, is transparent to the machine being monitored. Low tension is especially useful for elastic fiber such as textured polyester. Moreover, low tension permits mounting of the detector anywhere between thread spool and the machine.

The cited patent literature discloses threading via closed orifices such as eyelets. In contrast, the present invention allows simple threading via open sided, ladder type, guides. Threading can easily and quickly be accomplished with no break in thread and no visual input.

The present invention is an essentially self-cleaning device and, thereiore, is resistant to problems caused by compaction of dust. Several of the devices disclosed in the cited patents would require regular removal of dust for proper operation.

As a consequence of its sensitivity, the present invention has made provision for vibration isolation and resonant frequency mismatch of relevant components, including guides and base.

b. Fabric Monitors

A typical, prior art material/fabric monitor system involves placement of textile material between electrical contacts. When the material runs out, the contacts close a circuit. This approach, however, cannot detect feed problems such as snags. In addition, contacts can be fouled by dust and fibers.

U.S. Pat. No. 3,177,749 (K. J. Best, et al.), teaches a control for feeding, measuring and cutting strip material wherein a wheel having a plurality of apertures disposed therethrough interrupts a light source which is focused on a light sensitive element. This counter wheel makes contact with the material passing through the apparatus through the use of a pressure wheel which sandwiches the material between the pressure wheel and the counter wheel. This and other related devices require that tension/friction be applied to material. The tension/friction requirement limits some applications, especially the feeding of elastic material. In addition, these devices have limits on response time due to the momentum of moving parts. Such devices are subject to fouling by material inconsistency, snags and dust contamination, and are also limited to measuring length.

U.S. Pat. No. 4,286,487 entitled "APPARATUS FOR MONITORING THE DELIVERY OF MATERIAL" issued to L. P. Rubel, the inventor of the device disclosed herein, discloses an apparatus for monitoring the unwinding of a length of material from a spool, wherein the turning of a shaft which mounts the spool generates a pulsed electric signal for controlling a device. The apparatus detects whether fabric from a spool is tangled, snarled, or otherwise jammed or consumed. This apparatus is limited in response time by the angular momentum of the spool being monitored.

Unlike the cited monitor devices, the current monitor response time is a function of the frequency of vibration of a vibrating means. Moreover, the frequency of vibration can be designed to requirements. High speed operation anditity to variations in speed, tension, snags, knots and inconsistencies of moving material and resultant sensitivity to duty cycle of the machine being monitored makes possible the response to an array if fault modes and prediction of fault prior to damage. Response can be expanded to machine diagnosis and accounting.

SUMMARY OF THE INVENTION

Briefly described, the invention comprises a thread sensor combined With an electronic processor. The system detects knots and snags using signal magnitude and rate of change, employs pattern recognition to assist in the detection of changes to the take up/stitch formation cycle and averages signals in a unique way. More specifically, the elements of the invention include: 1) a sensor responsive to thread and fabric speed, thread and fabric tension, and the presence of knots or other inconsistencies; 2) electronic processing means which manipulate the sensor output signals to compute the status of the textile machine operation. The kinds of textile machine operations monitored include, but are not limited to, sewing machines, knitting machines, weaving machines and embroidery machines.

At the sensor, a filament material, typically either thread, yarn, or a fabric, is passed over an arm or reed. The arm includes a notch through which the filament passes. When the filament passes through the notch it causes a Hall effect sensor to produce a signal. The change in thread speed and impact of knots and inconsistencies cause the arm to vibrate at a greater or lesser amplitude.

The downstream signal processing of the apparatus derives and predicts the various different conditions. The preferred embodiment of the invention can generate the following information: 1) the presence of knots and inconsistencies exceeding set parameters; 2) snags or tension faults (including a snag at the exhaustion of a spool); 3) thread speed duty cycle pattern failure for a single duty cycle, i.e., stitch. The causes of the failure might indicate incorrect threading, broken thread, or failure of the take-up mechanism. All aspects of the duty cycle pattern are preferably compared to established patterns or parameters. According to the preferred embodiment, a model is used ill which a voltage or numeric value is established as a function of both speed and duty cycle time intervals; 4) signal average or length of thread drawn for a multiplicity of duty cycles, i.e., stitches over time. Changes in the average draw indicate or predict failures, for example, decrease in draw suggests skips, increase in draw suggests loose stitches. Draw changes also result from changes in stitch size and, 5) thread break or exhaustion of thread or material.

The apparatus determines whether the status or trend is outside of, or inconsistent with, preset or expected parameters. If it is, the invention will trigger a stop of the operation of equipment which is monitored by the device. Potential optional functions include: the diagnosis of the mechanical status along with a suggested correction, control of certain aspects of the machine including needle positioning, prediction of bobbin run out, detection of burred/damaged needles, and production accounting based on fabric drawn or stitch count.

The invention may be more fully understood by reference to the following drawings.

DETAILED DESCRIPTION OF THE INVENTION

During the course of this description like numbers will be used to identify like elements according to the different figures which illustrate the invention.

The present invention operates by sensing movement of thread, yarn or fabric. The movement information is utilized by comparing sensor data against preset parameters or comparison with anticipated patterns. If processed data is not within set boundaries, the equipment being monitored is stopped.

This system consists of essentially two parts: 1) a sensor, and 2) a signal processor. Those two parts are discussed separately below.

1. The Sensor

Figure 1:
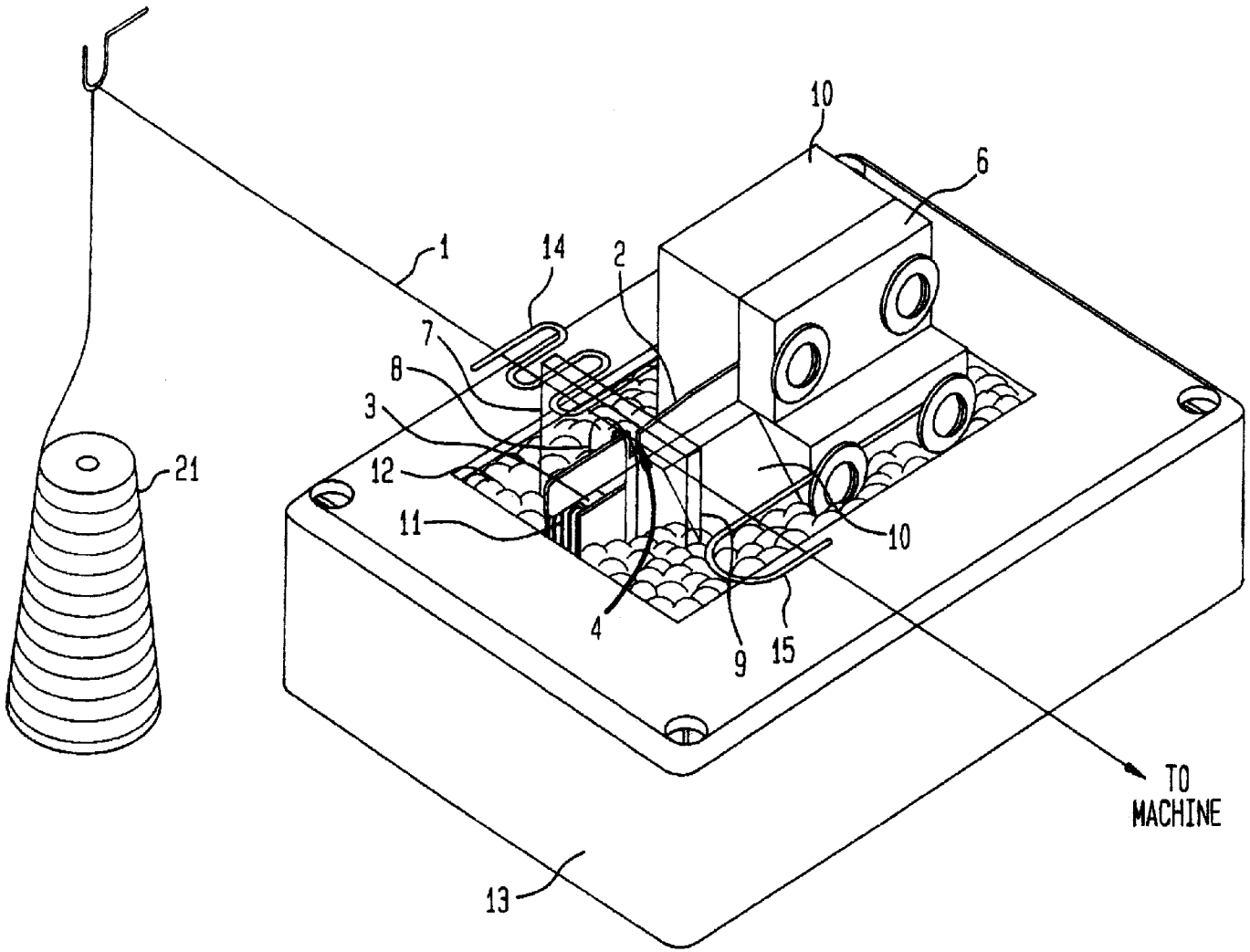
FIG. 1 is a front perspective view of the preferred embodiment of the invention illustrating the manner in which a thread passes through a notch in the thread sensor.

As seen in FIG. 1, moving material, 1 thread, yarn, fabric, or wire, is directed to pass over a vibrating arm or means 2. The vibrating means 2 is induced to vibrate due to contact with moving material 1. Vibration information, such as amplitude and frequency, is converted to an electrical analog of the mechanical vibration. In the preferred embodiment of this device, conversion to electrical analog is produced by a Hall effect sensor 3 due to changes in the magnetic field caused by vibrations of the steel vibrating arm or means 2 in proximity of a magnet. The magnet is positioned below the Hall effect sensor 3.

The vibrating means 2 can have multiple configurations. The design is dependent on sensor function. The vibrating means, shown in FIG. 2A, preferably comprises a shaped steel spring arm on which vibration is induced by the moving material 1. The induced vibration varies with the movement and tension of material 1. The vibrating means resonant frequency is determined by its geometry and composition.

Figures 2A, 2B, 3:
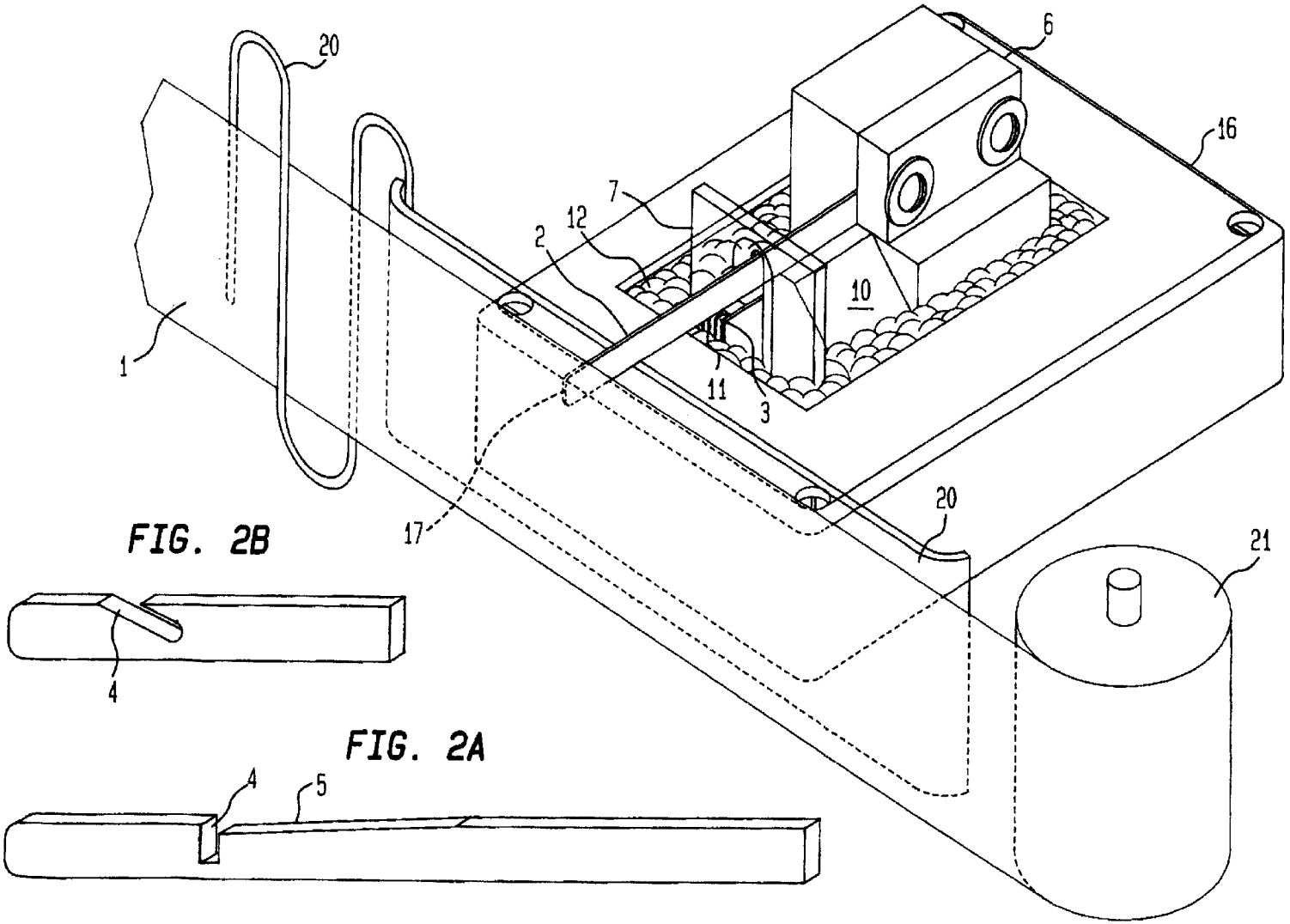
FIG. 2A is a perspective view of the preferred embodiment of the vibrating means.
FIG. 2B is a perspective view of a vibrating means according to an alternative embodiment thereof.
FIG. 3 is a perspective view of the invention used as a fabric motion and condition sensor showing a fabric passing across the sensor.

As seen in FIG. 2A, the vibrating means shown is designed for sensing the movement of thread or yarn or other filament material. It has the following characteristics:

a. The vibrating means 2 is presently a flat steel spring so that the primary mode of vibration is in one dimension, i.e., the vibration has one degree of freedom of motion. Restriction to one degree of freedom for vibration serves to reduce the number of permutations of frequency and amplitude generated by vibration of the vibrating means 2.

b. The vibrating means 2 has a resonant frequency that is significantly greater than the antidpated duty cycle or stitch frequency of the machine being monitored. The resonant frequency of the vibrating means 2 is analogous to a carrier wave where the amplitude is modulated by the duty cycle.

c. The vibrating means 2 has a notch or aperture 4. The size of the notch or aperture 4 is a function of dimensions of the needle or looper eye, and the anticipated maximum filament allowable knot/inconsistency dimensions. When a knot or filament inconsistency impinges on the notch 4 it causes a large amplitude vibration.

FIG. 2B illustrates a slanted aperture 4 used for an acute thread path wherein thread bending contributes to knot sensitivity.

d. The top edge of the vibrating means has a slope 5 so that yarn or filament material 1 is pulled or induced to slide into the notch 4.

Referring to FIG. 1, the vibrating means 2 is tightly mounted in cantilever configuration with the vibrating means 2 clamped between the mounting block 10 and clamp 6. It has the following structure:

a. The electronic pick up means 3 and magnet is mounted in proximity to the vibrating means 2 and near the free swinging end of the vibrating means 2 where maximum geometric displacement due to vibration is anticipated. A maximum displacement causes a maximum magnetic disturbance.

b. The free swing end of the vibrating means 2 is enclosed by a limitation means 7 which contains an aperture 8 which prevents movement of the vibrating means 2 beyond its elastic limit.

c. An aperture 8 in the limitation means 7 acts as a barrier to filament or material movement along inappropriate paths, specifically: 1) the filament 1 is prevented from snagging or looping on the free end of the vibrating means 2; 2) the filament 1 is prevented from going beneath the vibrating means 2; and 3) the back face of limitation means 9 assists the operator during threading in that it acts as an edge guide to ensure that the thread 1 must go in the notch 4 when the thread 1 is pulled toward the limiter inside edge.

d. In an industrial textile environment, the clearing of compacted dust requires mechanical down time. The mounting of the vibrating member 2 coupled with the design of the mounting block 10 and shape of aperture 8 is configured to cause dust to flow or fall away from surfaces adjacent to the vibrating means 2 and thereby avoid accumulation and compacting of dust in the path of vibration of vibrating rigid member. The elastic limit aperture 8 adjacent to vibrating means 2 has sharp edges and surfaces that slope away from vibrating member 2 so that gravity and vibration induce dust to move from the path of the vibrating member thereby precluding accumulation and compaction of dust. The mounting block 10 has sloped surfaces to direct: dust away from compaction about vibrating means 2.

e. The mounting block 10 includes channels 11 for the electrical leads from the magnetic sensor 3.

f. The sensor/transducer assembly is isolated from external vibration. Vibration isolation in the preferred embodiment includes the following features: 1) the mounting block 10 includes or is attached to a mounting plate. The large surface of the mounting plate is aligned perpendicular to gravity. Adjacent to and below that surface is loose resilient material 12; and, 2) resilient material 12 surrounds all surfaces of the mounting assembly located within the transducer assembly enclosure 13. Packing material isolates the mounting assembly from external vibration and shock and restricts movement of mounting assembly so that it remains properly positioned within the transducer enclosure 13.

g. The natural resonant frequency of the mounting assembly is significantly different than the resonant frequency of the vibrating means 2.

h. Guides 14 and 15 direct movement of the filament 1 and are mounted upstream and downstream of filament movement. The guides shown in FIG. 1 have ladder configuration for ease of threading. Upstream guide 14 provides tension control for the filament 1 passing over the vibrating means 2. The geometric and material charateristics of the guides 14 and 15 are such that the resonant frequencies are substantially different from the resonant frequency of the vibrating means 2.

i. The sensor enclosure 13 is attached to a mounting bracket means so that the entire assembly is in a path of filament 1 movement.

FIG. 3 illustrates an alternative embodiment of the sensor. The function of the sensor arrangement 16 shown in FIG. 3 is to monitor the movement of fabric 1 rather than the movement of yarn or filament 1 as shown in FIG. 1. The fabric 1 flows from a roll 21 and is guided by a guide means 20. Similarly, a clamping means 6 and a mounting block 10 hold the vibrating means 2. The vibrating means 2 has a rounded edge 17 which extends beyond the elastic limit aperture. The rounded edge 17 contacts the moving fabric 1. The motion of the fabric 1 induces vibration in vibrating means 2. The rest of the structure follows similar logic as is applied in the yarn or filament sensor/transducer assembly of FIG. 1. This adaptation of the present invention combined with appropriate signal processor circuits yields a speedometer and/or odometeir for any moving material. Speed information results from signal amplitude (peak detection) and draw/distance and is a function of speed and time.

The sensor means describes a general method for the determination of speed, wherein the signal amplitude of a resonating means is proportional to the speed of movement of material 1 forcing the system into resonance. In the preferred embodiment, the signal amplitude is found to have a linear relationship to speed given a constant tension.

2. Signal Processor

The signal processor may include several different permutations of analog and digital manipulation of the transducer signal to produce similar results.

Figure 4:
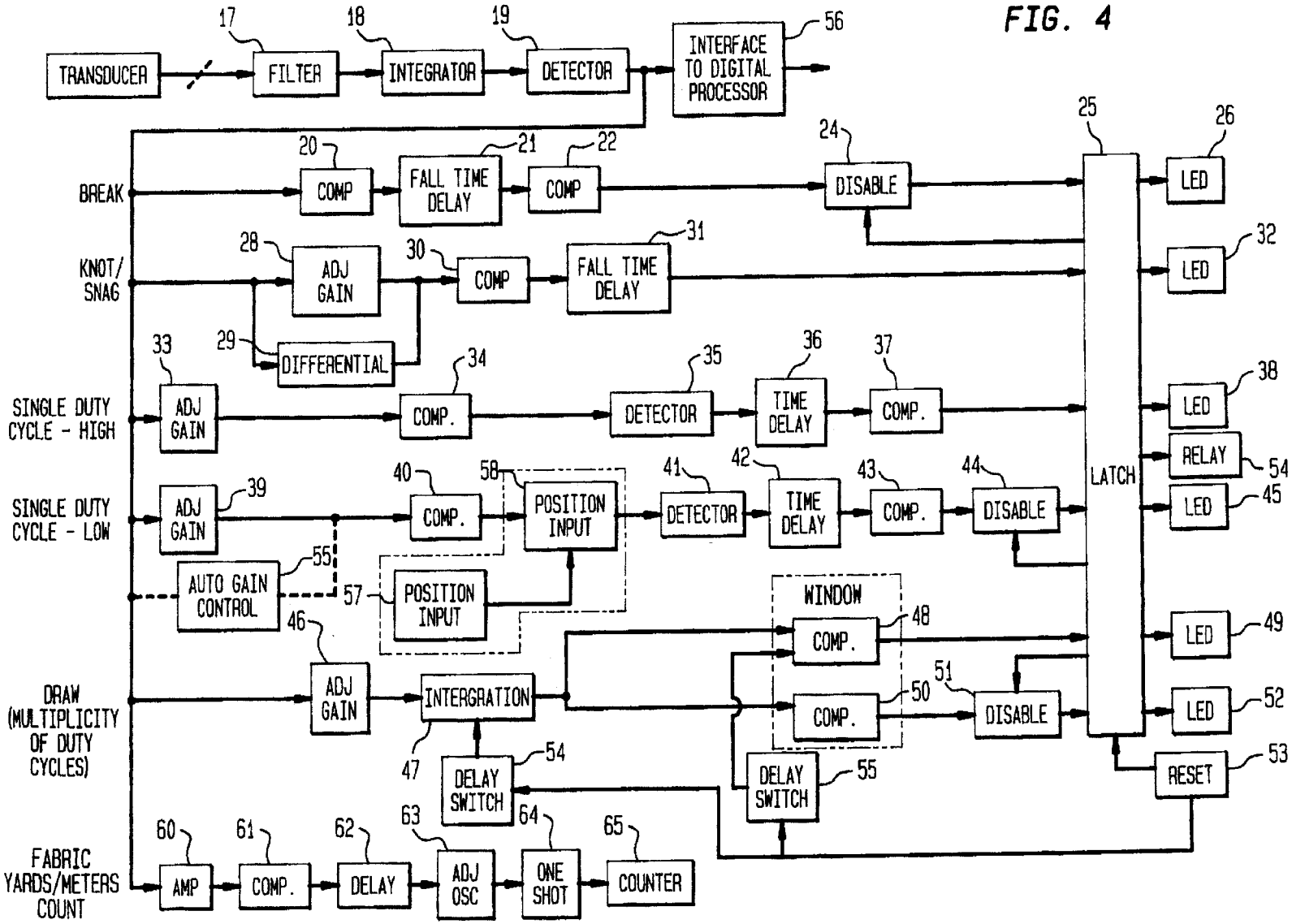
FIG. 4 is a flow chart illustrating the signal processing means and function.

Referring to FIG. 4, the signal processor of the present embodiment is illustrated in block diagram. The different branches, namely break, knot/snag, single duty cycle analysis, draw/multiplicity of duty cycles and fabric yards or meter count, allow the signal processor to perform combinations of the following five analog computations or determinations:

a. determination of thread break;

b. determination that a knot or fiber inconsistency exceeds allowable limits (as set by resonator notch size), or determination that tension or sudden snags exceed preset limits;

c. determination that filament speed pattern during a single (or limited number of) duty cycle has changed amplitude or time parameters from previously set values, note that during textile machine operation filament is pulled and released typically by the take up components of the textile machine. Change in filament speed is required to form loops in the filament at needles and loopers. An essential part of stitch formation is the pick up of the loops. Changes in take up speed pattern is indicative of improper threading, filament break, or other stitch problems;

d. determination that change of a signal average or draw of thread pulled over a period of time, i.e., a multiplicity of duty cycles, exceeds an allowed value. Such a trend indicates or predicts failures such as skips, loose or tight stitches, and feed malfunction; and, e. determination of unit length of material processed or produced by the machine being monitored.

Determinations that the above conditions a, b, c, or d exceed anticipated limits of normal operation will activate relay 54. The relay contacts are connected to work through the equipment being monitored to cause the machine to stop operation. LEDs 26, 32, 38, 45, 49, or 52 indicate to the operator which condition triggered the shut down, indicating means other than LEDs are possible. In addition, block 56 indicates an output port for further signal processing or recording. Further signal processing can be performed by a digital computer directly or via multiplexing for multiple sensor or machine inputs. The ability to monitor the operation of a large number of machines in a plant for many purposes, for example, checking for skips, needle damage, other mechanical faults, diagnosis of mechanical problems, and operator output: and production accounting, is dependent on the sophistication of software that drives the system.

3. The following describes the logic steps of the operation shown in FIG. 4:

a. The incoming signal from the sensor is passed through a filter 17. The filter is designed to pass only the resonant frequency of the sensor or transducer assembly vibrating means. Alternatively the filter 17 can be set to pass other useful frequencies. From the filter 17, the signal may be passed to a signal integrator 18 which has an operational frequency that is a function of vibrating means resonant frequency. The purpose of the filter 17 and integrator 18 is to enhance the signal to noise ratio (SNR). From the integrator 18, the signal is passed to detector/rectifier 19 and then to several circuit sections.

The configuration of the operational circuits shown in FIG. 4 is for use with essentially constant speed operation machines. Each circuit described in the following paragraphs computes conditions for a different failure mode.

b. Blocks 20 through 26 comprise a circuit which indicates that a thread break condition exists. The failure of the thread 1 to move for more than one or several duty cycle time periods represents a thread break. Comparator 20 provides a high voltage output only if the signal from block 19 is above noise level (i.e., thread movement is ongoing). Block 21 provides a peak detector and voltage fall time delay. The time delay exceeds the maximum anticipated duty cycle off time. Comparator 22 provides a high voltage output if the output of block 21 falls below normal. LED 26 indicates that the thread break circuit senses a thread break. Disable circuit 24 cancels the output of comparator 22 if the latch 25 is energized prior to receipt of a break indication from thread break blocks 20–22. The purpose of the disable function is as follows: after the machine being monitored is stopped, several failure modes would be indicated by the circuits of FIG. 4. The identification of which failure mode initiated the stop will expedite correction by the machine operator. Disable circuit sections 24, 44, 51 allow only one of the LED indicators (26, 45 and 52) to light. The illuminated LED indicates which failure identification circuit caused the stop.

c. Blocks 28 to 32 comprise a knot/snag circuit that determines if a knot, inconsistency or snag condition exists. If the sensor signal magnitude or increasing rate of change exceeds normal, the logic of the knot/snag circuit indicates a knot or snag problem. Block 28 is an adjustable gain amplifier. The gain is set by the operator so that snag/knot LED 32 is not illuminated during normal operation. The hold time of the delay 31 is set to allow clear observation of LED 32 by the operator. Block 29 is a rate of signal change (i.e., derivative function) used to enhance sensitivity to sudden snags or knots. The output of comparator 30 will change state (go high) if the incoming signal from block 28 or 29 exceeds a set normal value. Circuits 28 to 32 predict malfunctions in that they can sense problems, knots, snags and stop machine operations before stitch and fabric damage occurs.

d. Blocks 33 to 45 are designed to detect changes to the filament speed pattern generated by textile machine operation. The speed pattern typically includes a pull and release cycle produced by a take up mechanism and stitch formation. Ideally, the cyclical speed change pattern generated during stitch formation is compared to expected patterns. In the simple analog approach shown in FIG. 4, voltages which are a function of both sensor signal magnitude and stitch/duty cycle time pattern are compared to preset values. Changes indicate failure. The output of detector 19 is fed to two independent circuits shown as blocks 33 to 38 and blocks 39 to 45. Blocks 33 to 38 are directed to the filament high speed or pull portion of the stitch take up cycle. Logic of blocks 33 to 38 is that if the speed/sensor signal magnitude does not reach and remain at the level preset for normal high filament speed, then a high speed/pull failure will be indicated. An adjustable gain amplifier 33 is used to set signal level. Gain is set by the operator so that LED 38 is not illuminated during normal operation. Output of comparator 34 goes high when output of amplifier 33 reaches its upper range. The output of detector 35 is ideally a square wave with a frequency and ratio of on to off time similar to the duty cycle. Block 36 provides for two time delays. The first delay is a rise time delay requiring that the high speed component of the duty cycle must remain high as long as expected, as set by an adjustable gain amplifier 33. The second delay is a fall time delay inversely proportional to machine speed/duty cycle frequency, examples of high speed failure include misthreading and thread break. Blocks 39 to 45 mirror the logic of blocks 33 to 38. Blocks 39 to 45 monitor the low speed filament movement of the stitch duty cycle. Logic of blocks 39 to 45 is that if low filament speed of the expected duty cycle does not reach its low speed level and stay at that low level for the preset level and time, then a low speed/release failure is indicated. Examples of low speed failure include misthreading and thread wrapped up on a take-up cam. Disable circuit 44 functions identically to disable 24. Block 55 shows an alternative, where amplifier 39 is replaced with an automatic gain control. The adjustment to the monitor of the duty cycle would then be made by setting time constants in block 42. Thread break and knot/snag can also be detected by these circuits, with sensitivity dependent on circuit time constants.

Note that both knot/snag circuit of blocks 28 to 32 and/or single duty cycle analysis blocks 33 to 45 can be employed to indicate take-up cam failure, for examples on locked chain stitch type machines with cam take-ups for looper. On take-up cams, thread wrapped around the shaft would, in most cases, trigger a snag (blocks 28 to 32) or excessive "on time" indication (blocks 39 to 44). A machine stop triggered by this circuit can prevent an excessive amount of thread being wrapped around a cam or shaft during a thread break. This adaptation of elements of the present invention can be used to monitor or control fixed or variable speed machines.

e. Blocks 46 to 55 comprise a long-term average speed failure detecting circuit. The logic of the operation is that average or draw is approximately an integral of thread/material movement speed and time. The period of integration is for a multiplicity of stitches/duty cycle periods. The longer the period of integration, the more accurate the determination. The change in draw can be a result of skips, loose or tight stitches or feed malfunction. Block 46 comprises an adjustable amplifier. Block 47 comprises an integrator, where the period of integration is a large multiple of duty cycle periods. Blocks 48 and 50 form a window comparator with window opening set to within acceptable draw limits. If the limits set in blocks 48 and 50 for change of draw are within acceptable parameters, then a change in draw trending beyond those limits is a prediction of impending malfunction. The gain of amplifier 46 is set by the operator so that output of integrator 47 is approximately in the center of the window opening. The gain is set by adjusting between those positions which trigger high and low draw LEDs 49 and 52. During the adjustment or reset, i.e., when the reset button at 53 is activated by the operator, the integration time period of block 47 is reduced to accommodate the need for an average for adjustment or shortly after start up. A short time average is needed to make the adjustment easy for the operator. The time constant reduction is accomplished by a reducing part of the R in an RC integrator. The increase in R is applied gradually after release of reset 53,and the increase of R is controlled by timing and gradual switching means 54. Opening of window 48 and 50 is gradually reduced via timing and switching means in block 55. Large window opening just after start up is required to accommodate the rough average generated in a short time. Window opening is reduced subsequent to the increase in the averaging time interval. The disable 51 function is identical to the disable function of blocks 24 and 44.

f. Once a signal is inputted to latch 25, from any of the above circuits (output of blocks 24, 31, 37, 44, 48, or 51) a changed (low or high) output state is maintained until the reset 53 is activated by the operator. The latch 25 output activates relay 54. The function of disable blocks 24, 44 and 51 is to permit only one of the LEDs following the latch, to be illuminated at any time. The source or reason for the machine cut-off is then indicated by the appropriate LED.

g. Unit Length (i.e., yards/meters) Counting Circuit. Blocks 60 to 65 determine a count of unit length of fabric processed or produced by the machine being monitored. The counter is employed with constant speed machines. The fabric unit length is derived from thread motion only, thus providing a convenient counting means with a minimum amount of equipment. Signals can be tapped from a number of output points after block 19. In FIG. 4, the output is taken directly from block 19. Any signal output above noise level from block 19 indicates thread movement. The thread movement signal triggers comparator 61. The comparator output value is held in block 62 for the time interval required for movement of one-half of the integer unit length of material being processed. Block 62 corrects for integer truncation errors that otherwise would occur at each start or stop. The output of block 62 initiates and maintains operation of oscillator 63. The oscillator frequency is calibrated to the fabric output speed of the machine being monitored. The oscillator output is directed to one shot circuit 64 which produces the pulse time width signal required to operate the counter 65.

4. The following are variations of the circuits of the invention that can be used in other applications.

a. Burred needle determination. During normal sewing, the points of needles are frequently hammered down or deflected (i.e., the needles are blurred). On some fabrics, burred needles cause costly damage. Alternative sensor adaptations of the current invention can detect burrs. Signals generated by a filament being snagged on the rising needle are utilized. The filament typically is the loop caught and released by the needle during stitch formation. An example of this is the loop of thread from the secondary looper of a merrow type stitch machine, this second looper loop is picked up and released by the needle. As the looper thread is pulled off the needle, a snag at the burr will generate vibration on the needle and the looper thread. Vibration is also generated by the burred needle rising through/exiting the fabric. One sensor adaptation is tc place a Hall type magnetic sensor adjacent to the needle. Placement is dependent on position of the needle during loop release. In the merrow type stitch, a sensor could be on the sewing foot. As in FIG. 4, blocks 17 to 19, resonant frequency filtering is used to enhance signal to noise ration. In this case, the needle is the vibrating means and the circuit is tuned to the natural resonant frequency of the needle. The amplitude from block 19 is passed to a magnitude and differential comparison circuit as in block 28 to 32 or other pattern recognition means. Sensitivity can be enhanced by limiting signal processing to the time period during which the needle releases a loop. Alternatively, the looper or a sensor on the looper can be the vibrating means. In this case, increased looper thread speed, tension and draw caused by the delay of looper thread release from the burr is used. Also, the vibration caused by the burr is carried by the looper thread. An analogous event occurs with a tin can and string telephone. If the string is plucked (by a burred needle), then a "ping" is heard at the can. The signal processing method is the same as is used for a vibrating needle. Although mechanical and software requirements are a challenge, potential cost savings are significant.

b. Multiple inputs variable speed equipment. Monitoring of variable speed equipment can be monitored by comparing signals from several inputs. This mode of operation can use multiple sensors, one for each of several possible inputs. Inputs for one machine might include: sensors for each needle and looper, fabric input, tension only sensors and handwheel position sensor. In this approach ratios of sensor signals for filaments or fabric drawn through various inputs, as previously described above, is processed to determine if the operation of the equipment has changed or is trending to change beyond set normal limits. Examples of the foregoing might include:

1. A change in the ratio of thread drawn through the needle versus thread drawn through the looper, or a comparison of draw through various loopers, can be an indication that a malfunction has or will occur.

2. A comparison of thread "movement" indication output from comparator 40, simultaneous with either the handwheel position 57 or other thread sensor would via AND gate 58 indicate a single duty cycle or take-up failure. Similarly, a thread "nonmoving" output from comparator 22 or 37, simultaneous with a handwheel position duty cycle input indication of thread movement phase would indicate a thread break.

c. Digital signal processing. Block 56 is the interface for additional/alternate signal processing. This output amplitude is, via amplification or attenuation, and AC coupling, limited to acceptable impedance voltage or current levels of the multiplexer, digital processor, computer, recorder, etc., connected at this point. As the level of signal analysis increases in complexity, the cost of digital processing drops below analog processing. Mathematical manipulation, including operations similar to those done by the analog processor shown in FIG. 4, can be performed. In addition, signal patterns could be statistically compared to predetermined parameters or patterns stored in memory. Time or frequency domain functions such as fast- Fourier can be compared to predetermined parameters. Statistical correlation can be used for both operation monitoring and for machine diagnosis. Other data, such as fabric or thread use and stitch count, can be used for accounting purposes.

d. Bobbin thread monitor. Versions of the signal processor permit prediction of bobbin thread run out for automatic lock stitch machines. The machine would be stopped prior to exhaustion of bobbin thread. A simple system would use a counter coupled to an oscillator and counter system similar to blocks 60 to 65. When the thread drawn by the needle matches or approaches thread wound on the bobbin in the hook assembly, operation of the lockstitch machine is stopped. Also bobbin thread can be monitored for knots or inconsistencies during bobbin winding.

e. start value for averaging process: A preset value or number representing normal machine operation can be used as the initial start point average value following machine start up.

It will be understood that various changes in the details, materials, arrangements of parts and operational conditions can be made to the structure and function of the invention without departing from the spirit and scope of the invention as a whole.

I claim:

1. An apparatus for detecting changes to average speed for a multiplicity of stitch duty cycles of a filament or fabric consumed by a textile machine, said apparatus comprising:

a vibrating means mounted to a stationary base;

a sensor for sensing the vibration of said vibration means and giving off an electrical signal in proportion thereto;

electronic means for receiving said electrical signal and determining changes to average signal level; and, equating means for equating said average signal level to said average speed.

2. The apparatus of claim 1 wherein the time interval utilized to determine average speed is increased with time following adjustment or start up of textile machine.

3. The apparatus of claim 1 wherein the detected average signal maximum and minimum levels are compared to converging maximum and minimum reference levels following adjustment or start up of machine.

4. A monitor for use with textile type machines functioning during a combination of partial, singular or multiplicity of machine duty cycles, including a means to sense speed, tension and material condition of thread, yarn or fabric feeding along a path and means to process sensed information to determine and predict the following conditions: thread breaks and material exhaustion; material inconsistency; knots and snags; machine duty cycle pattern failures; take up failure and threading errors; draw per unit time failures; skipped stitch; feed and tension malfunction; machine mechanical diagnosis; and, stitch count determination, which consists of:

a speed and tension sensor which can be mounted anywhere along said path, having a means for sensing a combination of speed and tension of material moving through the textile machine and converting the combination of speed and tension of the material into a corresponding electrical signal;

an electronic signal processor which processes speed and tension sensor electrical signal output, said processor output being a prediction or determination of operational status of the machine being monitored;

an electrical connection between the speed, tension and material condition sensor and the electronic signal processor; and, indicator means electrically connected to the signal processor.

5. The monitor in claim 4 wherein the speed and tension sensor consists of a vibrating means, said vibrating means induced to vibration or deflection by contact with the moving material, wherein the resonant frequency of the vibrating means exceeds the duty cycle frequency of the machine being monitored, and a means to convert said vibrations or deflections to analogous electrical signals.

6. The monitor of claim 4 wherein the speed and tension sensor includes means for sensing material inconsistencies including knots and converting them into a corresponding electrical signal.

7. The monitor of claim 4 wherein the electronic signal processor consists of:

signal manipulation means, said signal manipulation means output being an analog or digital function of the sensor signal parameters;

setting adjustment means, used to preset signal levels to a required range or to establish preset, programmed or archived parameters; and, comparison means that compares the sensor or manipulation means output signal parameters to setting adjustment level means levels, wherein an indicator means is electrically connected to the electronic signal processor such that said indicator means indicates operational status or origin of failure of the machine being monitored.

8. The monitor in claim 4 wherein the electronic signal processor consists of an output means, said output means being electrically connected to the machine being monitored and said output means acting to control operation of the monitored device or to signal an operator.

9. The monitor in claim 4 wherein said indicator means indicates a diagnosis of the machine being monitored, based on a comparison of the sensor signal output amplitude and time parameters to programmed or archived parameter pattern.

10. The monitor in claim 4 wherein said indicator means indicates a status and diagnosis of the machine being monitored based on a comparison, of the time domain or frequency domain of sensor signal.

11. The monitor in claim 4 wherein the electronic signal processor consists of:

a means of filtering extraneous signals which are outside the resonant frequency of the vibrating means;

a means of controlling amplification of signals through circuit elements;

a means to block indicating of failures occurring after first failure, such that only the initial cause of failure is indicated; and, a means to reset signal processor circuits after a failure has been detected.

12. The monitor in claim 7 wherein the electronic signal processor includes:

a knot or material inconsistency determination means wherein the manipulation output generated is a function of speed and tension sensor signal amplitude and the comparison means compares signal amplitude to a predetermined level.

13. The monitor in claim 7 wherein the electronic signal processor, includes:

a knot or material inconsistency determination, wherein the manipulation output generated is a function of rate of change of the sensor signal value and the comparison means, compares the signal increase to a predetermined value.

14. The monitor of claim 7 wherein the electronic signal processor includes:

a means to recognize a duty cycle pattern failure, wherein the electronic signal processor output is generated for a single or limited number of duty cycles, and wherein the electronic signal processor includes manipulation means which generate an analog or digital value that is a combined function of the speed and tension sensor signal amplitude and duty cycle time parameters; and, a comparison means wherein the generated analog or digital value is compared to preset or programmed values.

15. The monitor of claim 7 which includes a draw failure determination, wherein the electronic signal processor output is generated for a multiplicity of duty cycles, wherein the electronic signal processor consists of:

the manipulation means which averages sensor signal for a multiplicity of duty cycles; and, the comparison means wherein average signal value is compared to the preset or programmed values.

16. The monitor in claim 4 wherein circuit elements of the electronic signal processor includes a combination of:

an averaging time interval reduction means, a comparison means wherein the maximum and minimum averaged signal levels are compared to converging maximum and minimum reference levels following adjustment; and, a means to set the initial average value to a level within the comparison window level, following start up.

17. The monitor of claim 4 having an output port consisting of an interface means to feed the signal output into additional devices.

18. The monitor of claim 4 wherein the electronic signal processor is electrically connected to a multiplicity of feed speed, tension, and material consistency sensors.

19. The monitor of claim 4 wherein stitch count is derived from thread sensor output and having a counter to count duty cycles.

20. The monitor in claim 19 wherein the counter has a means to count oscillator cycles or duty cycles and having a means to compare cycles to a predetermined value to indicate bobbin runout.

21. The monitor in claim 4 wherein the electronic signal processor output is inputted to an indicator means which indicates material movement speed and length drawn in conjunction with the electronic signal processor.

22. The vibrating means in claim 5 wherein the vibrating means consists of a spring, an edge of which contains a notch or an aperture within the spring, such that the notch or aperture guides the movement of thread, said notch or aperture dimension and shape being proportioned to react to passage of material inconsistencies such that vibration or deflection of vibrating and deflecting means rises significantly when dimensions of moving material inconsistency exceed acceptable limits, such limits being a function of textile machine needle or looper eye aperture dimensions.

23. The speed and tension sensor in claim 5 which consists of:

a mounting means being isolated from vibration, isolation means consisting of said mounting means supported by resilient material and said resilient material being contained by an enclosure;

a vibrating means rigidly affixed to one end, in a cantilever manner, to said mounting means; and, a limitation means affixed to mounting means such that movement of the free end of the cantilevered vibrating means is limited, said limitation means being fixed to assure that the vibrating means remains within its elastic limits.

24. The monitor of claim 23 wherein the limitation means contains an aperture, said aperture having sharp edges sloped away from the free end of a vibrating means, such that vibrating means vibration and slope of aperture act to direct dust away from the aperture opening.

25. A monitor of claim 5 wherein the speed and tension sensor includes thread guides mounted upstream and downstream of the vibrating means in the path of moving material, said thread guides having a resonant frequency substantially different from the resonant frequency of the vibrating means frequency, said thread guides being isolated from vibration.

26. The speed and tension sensor of claim 5 wherein the vibrating means contains a notch at the edge of the vibrating means adjacent to a limitation means, such that the thread is pulled against said limitation means and will be aligned and directed into said notch.

27. The speed and tension sensor of claim 23 the mounting means assembly comprise surfaces which are adjacent to the vibrating means and sloped downward and away from the vibrating means, whereby said sloped surfaces direct dust away from the vibrating means, such that accumulation of dust is precluded.

28. The apparatus of claim 27 wherein said aperture comprises a notch.

29. The monitor of claim 4 further comprising a length counter, wherein units of length of fabric being produced or processed by the machine being monitored is determined from the filament speed and tension sensor signal.

30. The length counter of claim 29 comprising a speed and tension sensor signal which activates an oscillator means wherein said oscillator means comprises: a frequency that is calibrated to fabric speed of the machine being monitored, and output that is counted by a counter means wherein said oscillator means is activated at the start of machine operation and continues after the machine stops for a time period required to correct for truncation error wherein said truncation error time period is approximately equal to the time required to process one half of the unit length counted by said counting means and wherein a signal to said counting means is maintained on at each cycle by a one shot like means for an interval required to operate counter means.

31. The monitor of claim 4 wherein the sensor means and the electronic signal processor further comprise a burred needle detection means, wherein the sensor outputs include a combination of sensor signals which are functions of vibration on the needle and increases in thread tension, speed and vibrations carried on the thread such that:

sensor signal increase is generated by filament snagging on a needle burr;

the electronic signal processor includes frequency filter means;

the electronic signal processor uses a combination of signal magnitude, signal rate of change and pattern recognition compared to predetermined values to determined burred needle condition; and, the electronic signal processor uses machine position input to synchronize signal processing to release of looper or fabric thread from the needle.

* * * * *